US009050484B2

(12) United States Patent
Flentye et al.

(10) Patent No.: US 9,050,484 B2
(45) Date of Patent: Jun. 9, 2015

(54) EXERCISE DEVICE AND HANDLE FOR SAME

(71) Applicant: SPRI PRODUCTS, INC., Libertyville, IL (US)

(72) Inventors: Herbert T. Flentye, Glenview, IL (US); Gregory Niederlander, Gurnee, IL (US)

(73) Assignee: SPRI PRODUCTS, INC., Libertyville, IL (US)

( * ) Notice: Subject to any disclaimer, the term of this patent is extended or adjusted under 35 U.S.C. 154(b) by 95 days.

(21) Appl. No.: 13/644,428

(22) Filed: Oct. 4, 2012

(65) Prior Publication Data

US 2014/0051559 A1 Feb. 20, 2014

Related U.S. Application Data

(63) Continuation-in-part of application No. 13/585,597, filed on Aug. 14, 2012, now Pat. No. 8,876,678, and a continuation-in-part of application No. 13/610,549, filed on Sep. 11, 2012.

(51) Int. Cl.

| | |
|---|---|
| ***A63B 21/02*** | (2006.01) |
| ***A63B 71/00*** | (2006.01) |
| ***A63B 21/00*** | (2006.01) |
| ***A63B 23/035*** | (2006.01) |
| ***A63B 23/04*** | (2006.01) |
| ***A63B 23/12*** | (2006.01) |
| ***A63B 21/04*** | (2006.01) |

(52) U.S. Cl.

CPC ..... *A63B 21/00065* (2013.01); *A63B 21/1465* (2013.01); *A63B 21/1469* (2013.01); *A63B 23/0355* (2013.01); *A63B 23/0488* (2013.01); *A63B 23/1245* (2013.01); *A63B 21/0428* (2013.01); *A63B 21/00043* (2013.01)

(58) Field of Classification Search

USPC ..... 482/139, 92, 121–126

See application file for complete search history.

(56) References Cited

U.S. PATENT DOCUMENTS

| | | | | |
|---|---|---|---|---|
| 113,384 | A | 4/1871 | Barnett | |
| 232,579 | A | 9/1880 | Weeks | |
| 652,617 | A | 6/1900 | Hotz | |
| 2,930,614 | A | 3/1960 | McIntosh | |
| 3,427,023 | A | 2/1969 | Silberman | |
| 4,756,527 | A * | 7/1988 | Ledbetter | 482/139 |
| 5,431,617 | A | 7/1995 | Rattray, Jr. | |
| 5,505,677 | A | 4/1996 | Hinds | |
| 5,800,322 | A * | 9/1998 | Block | 482/126 |
| 6,497,641 | B1 | 12/2002 | Hinds | |
| 6,676,576 | B1 | 1/2004 | Wu | |
| 6,923,750 | B1 | 8/2005 | Hinds | |
| 7,147,592 | B2 | 12/2006 | Hinds | |
| 7,316,636 | B1 | 1/2008 | Hinds | |
| 7,326,157 | B2 | 2/2008 | Wu | |
| 7,344,485 | B1 | 3/2008 | Simpson | |
| 7,357,762 | B1 | 4/2008 | Terry | |

(Continued)

*Primary Examiner* — Loan H Thanh
*Assistant Examiner* — Megan Anderson
(74) *Attorney, Agent, or Firm* — Barnes & Thornburg LLP

(57) ABSTRACT

An exercise device comprising an elongate member and a pair of handles associated with the end of the elongate member. Each handle includes a grip defining a channel having two ends and an endless strap forming a loop extending through the channel. The loop is engaged with the elongate member to secure the elongate member to the handle. The exercise device may include a connector engaged with the elongate member and the handle to secure the elongate member to the handle.

12 Claims, 3 Drawing Sheets

(56) References Cited

U.S. PATENT DOCUMENTS

| | | | | |
|---|---|---|---|---|
| 7,377,886 | B2 * | 5/2008 | Wu | 482/126 |
| 7,448,990 | B2 | 11/2008 | Wu | |
| 7,455,632 | B2 | 11/2008 | Block et al. | |
| 7,503,883 | B2 * | 3/2009 | Madden | 482/126 |
| 7,578,775 | B2 | 8/2009 | Terry | |
| 7,625,324 | B1 | 12/2009 | Hinds | |
| 7,628,743 | B1 * | 12/2009 | Flentye et al. | 482/126 |
| 7,641,604 | B2 * | 1/2010 | Blount | 482/139 |
| D650,873 | S | 12/2011 | Terry | |
| 8,075,461 | B2 | 12/2011 | Terry | |
| 8,075,462 | B1 | 12/2011 | Hinds | |
| 8,152,703 | B1 | 4/2012 | Hinds | |
| 8,348,814 | B1 | 1/2013 | Hinds et al. | |
| 8,480,549 | B1 | 7/2013 | Hinds et al. | |
| 8,491,446 | B2 | 7/2013 | Hinds et al. | |
| 8,657,727 | B1 | 2/2014 | Kassel et al. | |
| 2005/0075223 | A1 | 4/2005 | Wu | |
| 2005/0137066 | A1 | 6/2005 | Wu | |
| 2006/0105893 | A1 * | 5/2006 | Chen | 482/126 |
| 2007/0155600 | A1 * | 7/2007 | Cunningham et al. | 482/126 |
| 2008/0300117 | A1 | 12/2008 | Madden | |
| 2009/0176634 | A1 | 7/2009 | Wu | |
| 2011/0237410 | A1 * | 9/2011 | Perez | 482/129 |
| 2012/0302406 | A1 | 11/2012 | Hinds et al. | |
| 2013/0288864 | A1 * | 10/2013 | Holland | 482/126 |

* cited by examiner

EXERCISE DEVICE AND HANDLE FOR SAME

CROSS REFERENCE TO RELATED APPLICATIONS

This application is a continuation-in-part of U.S. patent application Ser. No. 13/585,597 titled "Exercise Device and Handle for Same", filed Aug. 14, 2012, and U.S. patent application Ser. No. 13/610,549 titled "Elongate Member For Forming An Exercise Device", filed Sep. 11, 2012.

The present disclosure relates generally to an exercise device.

BACKGROUND

Resistance exercise devices comprising a stretchable elastic tube and a pair of handles are known. An example of a resistance exercise device including a stretchable elongate tube is disclosed, for example, in U.S. Pat. No. 5,800,322. Such exercise devices typically are available in tubes of different resistances. The resistance is based upon the resistance of the tube.

SUMMARY

The present disclosure is directed to an exercise device comprising an elongate member and at least one handle associated with an end of the elongate member. The handle includes a grip defining a channel having two ends and an endless strap forming a loop extending through the channel. The loop is engaged with the elongate member to secure the elongate member to the handle. The exercise device may include a connector engaged with the elongate member and the handle to secure the elongate member to the handle. The loop may be engaged with the connector at two locations. The connector may define a pair of slots, with the endless strap extending through each of the slots to engage the loop and the connector at two locations on the connector. The grip may comprises a tubular member and the channel extends the length of the tubular member and is coaxial with the tubular member. A gripping tubular member or other gripping material may be disposed about the tubular member. The elongate member may be comprised of at least one elastic tube, and may comprise multiple elastic tubes that are braided together. The endless strap may be formed of nylon or any other suitable material.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

DETAILED DESCRIPTION

While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

Figure 1:
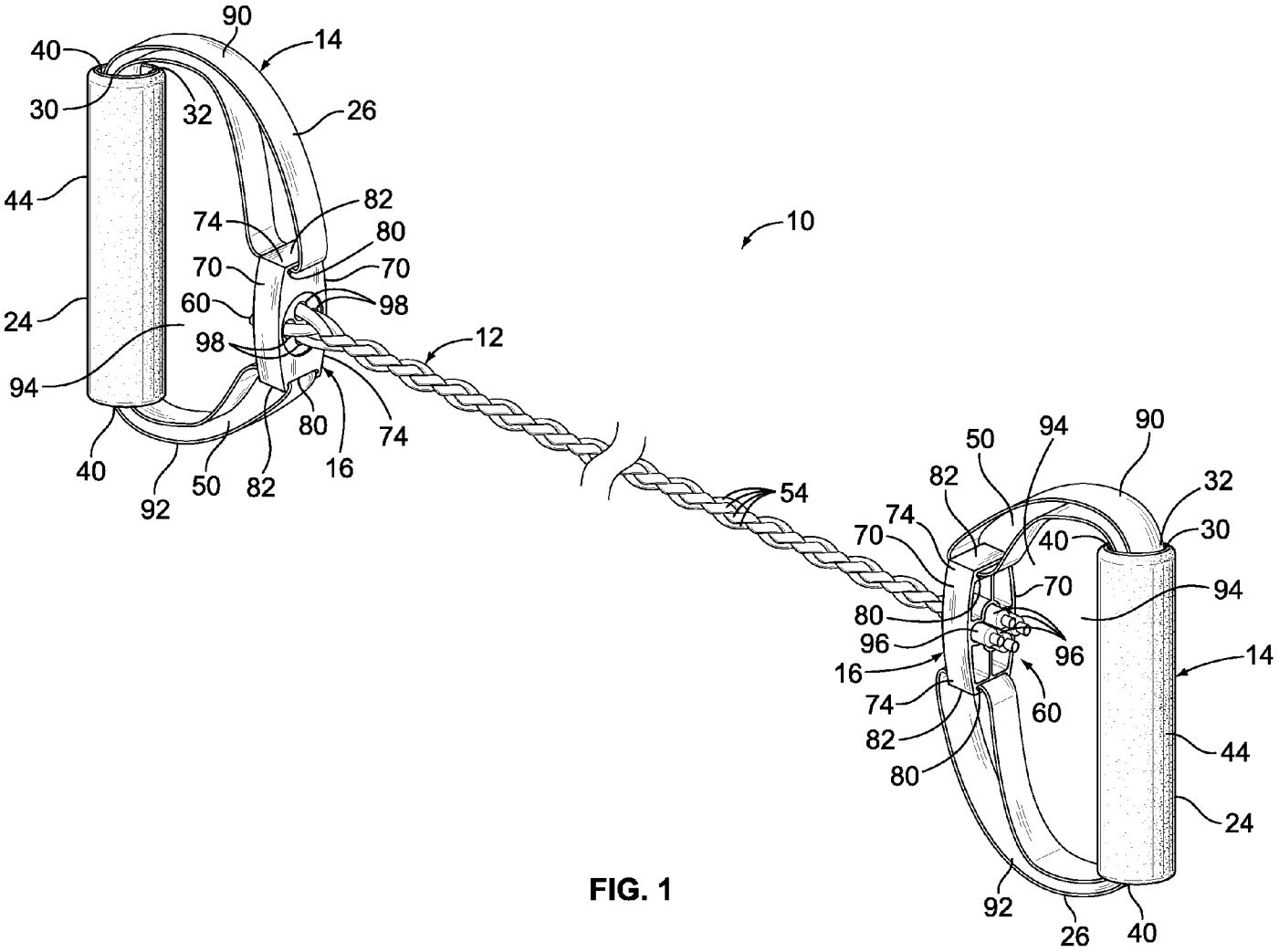
FIG. 1 is a perspective view of an exercise device in accordance with an embodiment of the present disclosure.
Figure 2:
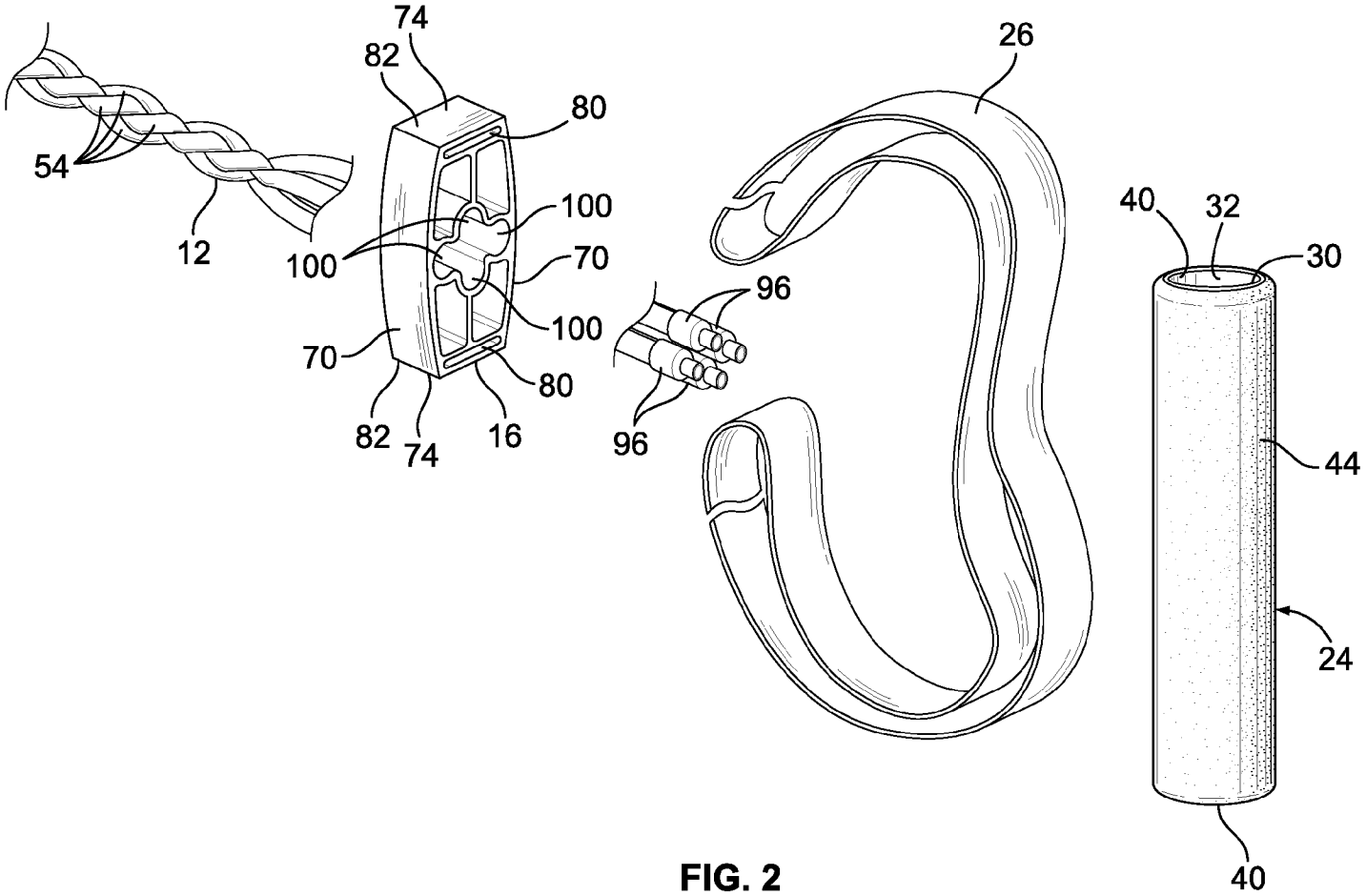
FIG. 2 is an exploded view of the exercise device of FIG. 1, illustrating the elongate member and the endless strap in broken views.

FIGS. 1-2 depict an illustrated embodiment of an exercise device 10 in accordance with an embodiment of the present disclosure comprising an elongate member 12, a pair of handles 14 engaged with the elongate member, and a pair of connectors 16 engaged with the elongate member and the handles to secure the elongate member to the handles. Each handle 14 comprises a grip 24 and an endless strap 26. The illustrated grip 24 comprises an inner tube 30 defining a channel 32 having two ends 40, and an outer tube 44. The outer tube 44 is disposed about the inner tube 30 and is concentric therewith. The inner tube 30 is constructed of a plastic or other suitable material. The outer tube 44 is constructed of foam rubber or any other suitable gripping material. The grip 24 may have any other suitable construction and configuration in accordance with other embodiments of the present disclosure.

The illustrated endless strap 26 comprises an inelastic material such as, for example, nylon. The endless strap 26 forms a loop 50. The endless strap 26 may be constructed of a strap having two ends whereby the ends of the strap are joined together in any suitable manner such as by stitching or the like. One of the ends of the strap may overlap the other end and the strap may be stitched along the overlap to secure the two ends together to form the endless strap 26. The ends may be joined together to form the loop 50 in any other suitable manner in accordance with other embodiments of the present disclosure. Additionally, the loop 50 may be formed in any other suitable manner in accordance with other embodiments of the present disclosure. The loop 50 may also include portions of the endless strap 26 secured together along the loop 50 in accordance with other embodiments of the present disclosure. The endless strap 26 is shown broken view in the exploded view of FIG. 2 for illustrative purposes to show separated components of the handle 14.

The elongate member 12 illustrated in FIGS. 1 and 2 is in the form of a cord formed of four elastic tubes 54 that are braided together. The elongate member 12 has two ends 60. The elastic tubes 54 may be in the form of stretchable or otherwise elastic tubes having a pair of ends. The elongate member 12 in accordance with other embodiments may comprise any other suitable elastic material or other material. The cord may comprise any other suitable number of tubes 54. The elongated member 12, shown in broken view in FIGS. 1-2, may have any suitable length.

Each of the illustrated connectors 16 includes a pair of opposed sides 70 and a pair of opposed ends 74. Each connector 16 defines a slot 80 adjacent each end 74 extending the height of the connector 16 for receiving the endless strap 26 to engage the connector 16 and to secure the elongated member 12 to the handle 14. The endless strap 26 extends around a wall 82 that defines the slot 80 adjacent each end 74 of the connector 16. The slots 80 may be defined in any other suitable manner in accordance with other embodiments of the present disclosure. Further, the endless strap 26 may be engaged with the connector 16 in any other suitable manner in accordance with other embodiments of the present disclosure to secure the elongate member 12 to the handle 14. The elongated member 12 may be secured to the handle 14 in any other suitable manner in accordance with other embodiments of the present disclosure.

In the illustrated embodiment, at or otherwise adjacent each end 60 of the exercise device 10, the loop 50 extends through the channel 32 and has portions 90 and 92 extending outside both ends 40 of the channel engaging the connector 16 and the loop 50. The endless strap 26 is received by slots 80 of the connector 16 to engage the loop 50 at two locations on the connector, e.g., adjacent ends 74 of the connector. The handles 14 and the connector 16 form a gripping loop 94 on each end of the exercise device 10 to receive and engage a hand, foot or other limb or structure in connection with performing exercises. Thus, in the illustrated embodiment, the endless strap 26 passes through the slots 80 and the loop 50 extends through the channel 32 and the endless strap is not fixedly secured to the connector 16 or the grip 24. The endless strap 26 may be fixedly secured to the connector 16 or the grip 24 in accordance with other embodiments of the present disclosure.

In the illustrated embodiment, each of the tubes 54 is engaged with the connector 16. Each of the tubes 54 include an enlarged end that may be in the form of a bulbous end 96. Four holes 98 receive the respective tubes 54 and four contiguous bores 100 receivingly engage the respective bulbous ends. Each hole 98 is sized to receive a receptive tube 54 and to prevent the respective bulbous end 96 from passing therethrough. Each bore 100 is sized to receive a respective one of the bulbous ends 96 to releasably engage or otherwise secure the bulbous end and the handle 14.

While the elastic tubes 54 and bulbous ends 96 are shown as having generally circular cross-sections and having diameters, the elastic tubes and/or enlarged ends may have different cross-sections, for example, a square-shaped, hexagonal, pentagonal, or other cross-sectional. The elongate member 12 may be constructed of any other resilient material or other material and have any other suitable dimensions and configuration in accordance with other embodiments of the present disclosure. In the illustrated embodiment, the bulbous ends 96 are formed by insertion of cylindrical or tubular elements within the channel defined by the elongate member 12. The bulbous ends 96 may be associated with the elastic tubes 54 as disclosed above or in any other suitable manner. The bulbous or otherwise enlarged ends may be formed by any other suitable means and also may be in the form of any other type of enlarged element formed in any suitable manner anywhere along the length of the elongate member 12 that engages the handles 14.

The exercise device 10 may be formed in any suitable manner depending upon the structure of the elongate member 12, connector 16, the grip 24 and the endless strap 26. For example, as indicated above, the endless strap 26 may initially be in the form of a strap having two ends that are stitched or otherwise joined together to form the loop 50. The stitching of the two ends may occur after the strap is doubled over and passed through the channel 32 and after the strap is passed through slots 80. The exercise device 10 may be formed in any other suitable manner.

Figure 3:
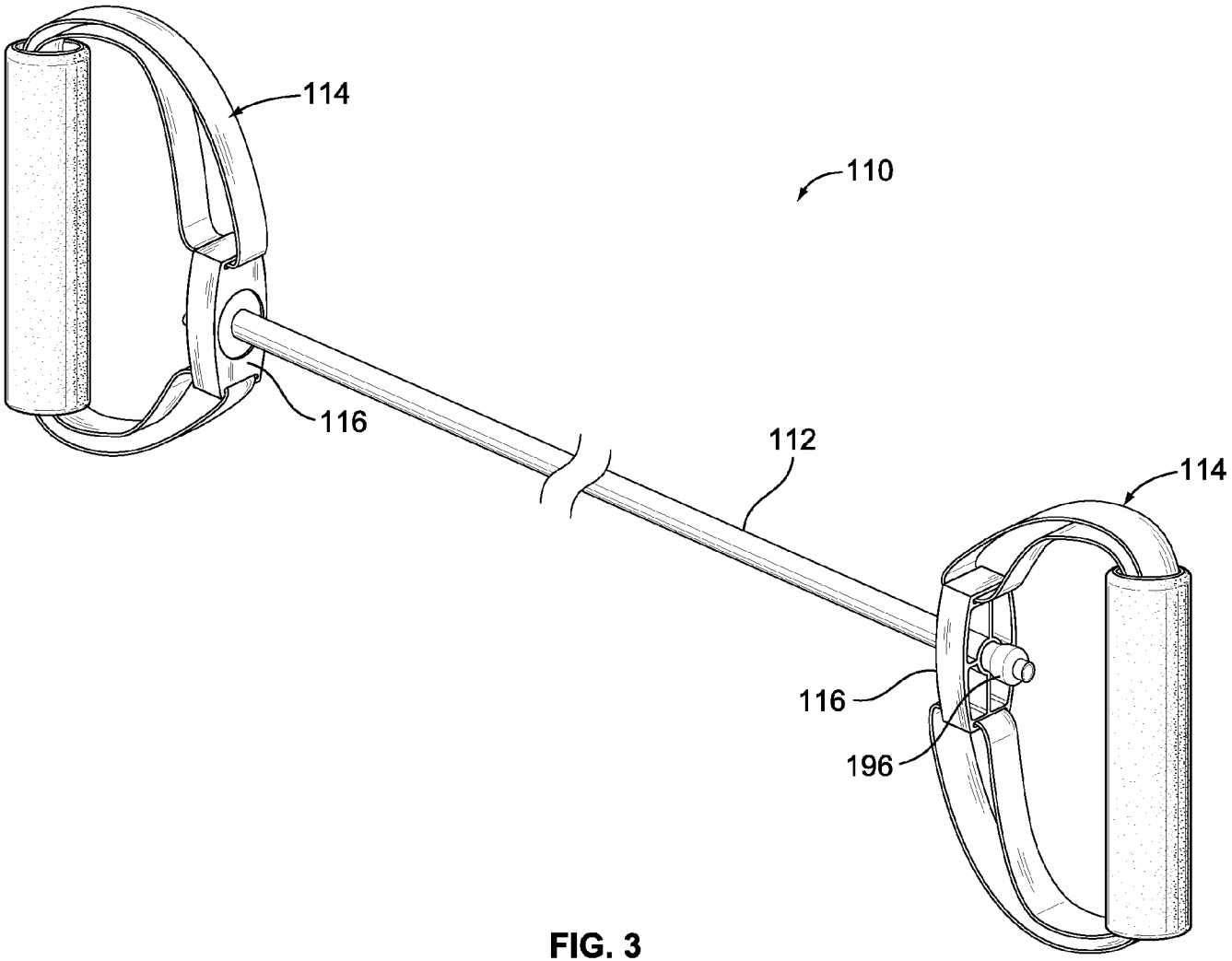
FIG. 3 is a perspective view of an exercise device in accordance with an other embodiment of the present disclosure.

FIG. 3 illustrates an exercise device 110 in accordance with an other embodiment of the present disclosure comprising an elongate member 112, a pair of handles 114 engaged with the elongate member, and a pair of connectors 116 engaged with the elongate member and the handle to secure the elongate member to the handles. In the embodiment of FIG. 3, the elongate member 112 is in the form of a stretchable or otherwise elastic tube having a pair of ends. On each end, a bulbous end 196 releasably secures the elastic tube 112 to the handle 114.

While the elongate member 112 and enlarged ends in the form of bulbous ends 196 are shown as having a generally circular cross-section and having diameters, the elastic tube and/or enlarged ends may have different cross-sections, for example, a square-shaped, hexagonal, pentagonal, or other cross-sectional. The elongate member 112 may be constructed of any other resilient material or other material and have any other suitable dimensions and configuration in accordance with other embodiments of the present disclosure. In the illustrated embodiment, the enlarged ends 196 are formed by insertion of cylindrical elements within the channel defined by the elongate member 112. The enlarged ends may be associated with the elastic tube as disclosed above or in any other suitable manner. The enlarged ends may be formed by any other suitable means and also may be in the form of any other type of enlarged element formed in any suitable manner anywhere along the length of the elongate member 112 that engages the handle 114.

The exercise device in accordance with the present disclosure may provide many benefits. For example, the present disclosure provides an exercise device that is durable and cost effective to manufacture. Because of the configuration of the strap and the other components of the handle, the handle can accommodate heavy loads and will extend the life of the exercise device.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

The invention claimed is:

1. An exercise device comprising;

an elongate member comprising an elastic tube;

a handle associated with an end of the elongate member, the handle including a grip defining a channel having two ends and an endless strap, the endless strap forming a closed loop, the closed loop extending through the channel such that two portions of the endless strap extend through the entire length of the channel, the closed loop engaged with the elongate member to secure the elongate member to the handle; and a connector engaged with the elongate member for securing the elongate member to the handle, the strap being engaged with the connector at two locations on the connector such that the closed loop extends from one location through the channel to the other location.

2. The exercise device of claim 1 wherein the elongate member comprises multiple elastic tubes that are braided together.

3. The exercise device of claim 2 wherein each of the elastic tubes has an enlarged end for engaging the connector.

4. The exercise device of claim 3 wherein the connector defines a plurality of holes, each hole receiving a respective one of the braided tubes and wherein each hole is sized to prevent passage therethrough of a respective enlarged end.

5. The exercise device of claim 1 wherein the connector has two opposed ends, the closed loop engaged with the connector adjacent to each end.

6. The exercise device of claim 5 wherein the connector defines a pair of slots, each slot adjacent to a respective end, the endless strap extending through each of the slots to engage the closed loop and the connector at said two locations on the connector.

7. The exercise device of claim 1 wherein the endless strap is formed by stitching a strap having two ends to form the closed loop.

8. The exercise device of claim 1 wherein the grip comprises a tubular member and the channel extends the length of the tubular member and is coaxial with the tubular member.

9. The exercise device of claim 1 wherein the grip comprises a tubular member and gripping material disposed about the tubular member, the tubular member defining the channel of the grip.

10. The exercise device of claim 1 wherein the endless strap is comprised of nylon.

11. An exercise device comprising:

an elongate member comprising an elastic tube;

a handle associated with an end of the elongate member, the handle including a grip defining a channel having two ends and an endless strap, the endless strap itself forming a closed loop, the closed loop extending through the channel such that two portions of the endless strap extend entirely through the channel; and a connector engaged with the closed loop and the elongate member securing the elongate member to the handle the strap being engaged with the connector at two locations on the connector such that the closed loop extends from one location through the channel to the other location.

12. The exercise device of claim 11 wherein the elongate member comprises multiple elastic tubes that are braided together.

* * * * *